US006819741B2

(12) United States Patent
Chidester

(10) Patent No.: US 6,819,741 B2
(45) Date of Patent: Nov. 16, 2004

(54) APPARATUS AND METHOD FOR SHAPING HIGH VOLTAGE POTENTIALS ON AN INSULATOR

(75) Inventor: Charles Lynn Chidester, West Bountiful, UT (US)

(73) Assignee: Varian Medical Systems Inc., Palo Alto, CA (US)

( * ) Notice: Subject to any disclaimer, the term of this patent is extended or adjusted under 35 U.S.C. 154(b) by 0 days.

(21) Appl. No.: 10/378,174

(22) Filed: Mar. 3, 2003

(65) Prior Publication Data

US 2004/0174956 A1 Sep. 9, 2004

(51) Int. Cl.[7] ..... H01J 35/06
(52) U.S. Cl. ..... 378/136; 378/143
(58) Field of Search ..... 378/119, 136, 378/139, 143, 144

(56) References Cited

U.S. PATENT DOCUMENTS

| | | | | |
|---|---|---|---|---|
| 4,412,938 A | | 11/1983 | Kakizaki et al. | |
| 4,618,977 A | * | 10/1986 | Brettschneider et al. | 378/139 |
| 4,685,118 A | * | 8/1987 | Furbee et al. | 378/114 |
| 4,738,798 A | | 4/1988 | Mahler | |
| 4,774,137 A | | 9/1988 | Alberts et al. | |
| 5,238,607 A | | 8/1993 | Herron et al. | |
| 5,340,500 A | | 8/1994 | Chao et al. | |
| 5,515,413 A | * | 5/1996 | Knudsen et al. | 378/136 |
| 5,556,716 A | | 9/1996 | Herron et al. | |
| 5,866,252 A | | 2/1999 | de Rochemont et al. | |
| 6,148,061 A | | 11/2000 | Shefer et al. | |
| 6,195,411 B1 | * | 2/2001 | Dinsmore | 378/65 |

OTHER PUBLICATIONS

Article entitled "*Multilayer High Gradient Insulator Technology;*" IEEE Transactions on Dielectrics and Electrical Insulation, vol. 7, No. 3, Jun. 2000, pp. 334–339; by S.E. Sampayan, P.A. Vitello, M. L. Krogh and J. M. Elizondo.

* cited by examiner

*Primary Examiner*—Craig E. Church
*Assistant Examiner*—Jurie Yun
(74) *Attorney, Agent, or Firm*—Workman Nydegger

(57) ABSTRACT

An apparatus and method for reducing the incidence of electric field stress on portions of insulating structures within high voltage devices is disclosed. Each of the embodiments disclosed herein modifies the conductive properties of the insulating structure surface in a non-uniform manner such that the distribution of voltage potential along the surface thereof is more fully equalized during operation of the high voltage device. This, in turn, reduces the per unit stress on the insulating structure caused by the electric field of the high voltage device. Through embodiments of the present invention are preferably directed to utilization in x-ray tube devices, a variety of high voltage devices may benefit from application of the disclosed matter.

14 Claims, 7 Drawing Sheets

APPARATUS AND METHOD FOR SHAPING HIGH VOLTAGE POTENTIALS ON AN INSULATOR

CROSS-REFERENCE TO RELATED APPLICATIONS

Not applicable.

BACKGROUND OF THE INVENTION

1. The Field of the Invention

The present invention generally relates to high voltage devices. More particularly, the present invention relates to an apparatus and method for adjusting voltage potentials on the surface of insulating structures used in high voltage devices.

2. The Relevant Technology

X-ray generating devices are extremely valuable tools that are used in a wide variety of applications, both industrial and medical. For example, such equipment is commonly employed in areas such as medical diagnostic examination, therapeutic radiology, semiconductor fabrication, and materials analysis.

Regardless of the applications in which they are employed, most x-ray generating devices operate in a similar fashion. X-rays are produced in such devices when electrons are emitted, accelerated, then impinged upon a material of a particular composition. This process typically takes place within an x-ray tube located in the x-ray generating device. The x-ray tube generally comprises a vacuum enclosure, a cathode, and an anode. The cathode generally comprises a metallic cathode head housing a filament that, when heated via an electrical current, emits electrons. The cathode is disposed within the vacuum enclosure, as is the anode that is oriented to receive the electrons emitted by the cathode. The anode, which typically comprises a graphite substrate upon which is disposed a heavy metallic target surface, can be stationary within the vacuum enclosure, or can be rotatably supported by a rotor shaft and a rotor assembly. The rotary anode is typically spun using a stator. Often, the vacuum enclosure is disposed within an outer housing for cooling and insulating purposes.

In operation, an electric current is supplied to the cathode filament, causing it to emit a stream of electrons by thermionic emission. A high electric potential, or voltage, placed between the cathode and anode causes the electron stream to gain kinetic energy and accelerate toward the target surface located on the anode. The point at which the electrons strike the target surface is referred to as the focal spot. Upon approaching and striking the focal spot, many of the electrons convert their kinetic energy and either emit, or cause the target surface material to emit, electromagnetic radiation of very high frequency, i.e., x-rays. The specific frequency of the x-rays produced depends in large part on the type of material used to form the anode target surface. Target surface materials having high atomic numbers ("Z numbers"), such as tungsten carbide or TZM (an alloy of titanium, zirconium, and molybdenum) are typically employed. The target surface of the anode is angled to minimize the size of the resultant x-ray beam, while maintaining a sufficiently sized focal spot. The x-ray beam is collimated before exiting the x-ray tube through windows defined in the vacuum enclosure and outer housing. The x-ray beam is then directed to the x-ray subject to be analyzed, such as a medical patient or a material sample.

Several types of x-ray tubes are commonly known in the art. Double-ended x-ray tubes electrically bias both the cathode and the anode with a high negative and high positive voltage, respectively. The voltage applied to the cathode and anode may reach +/−75 kilovolts ("kV") or higher during tube operation, depending on the type of x-ray tube. In contrast, single-ended x-ray tubes electrically bias only the cathode, while maintaining the anode at the housing or ground potential. In such tubes, the cathode may be biased with a voltage of −150 kV or more during tube operation. In either case, a sufficient differential voltage is established between the anode and the cathode to enable electrons produced by the cathode filament to accelerate toward the target surface of the anode.

Because of the high voltage differential present between them, an electric field is created between the anode and the cathode during tube operation. The high voltages present at the anode and/or cathode also necessitate the use of insulating structures supportably connecting the anode and/or cathode to the vacuum enclosure or outer housing to electrically isolate them from the rest of the tube. These insulating structures are typically composed of an insulative material, such as glass or ceramic, and may comprise a variety of shapes. Regardless of their shape however, the insulating structures must accommodate the reduction in voltage from the high voltage present at the anode and/or cathode to the much lower housing or ground potential typically present at the surface of the vacuum enclosure.

The interaction of the electric field with the insulating structures for the anode and/or cathode creates a voltage potential distribution along the insulating length of the insulating structure. The insulating length is defined as the length of insulating structure existing between the high voltage source and the low voltage device structure. In an x-ray tube, the insulating length of the insulating structure extends from the anode and/or cathode to the vacuum enclosure, with high voltage present in the insulating structure near the anode or cathode, and low voltage in the insulating structure near the enclosure. In this way, the high voltage of the electric field is gradually dissipated along the length of the insulating structure, thereby electrically isolating the anode and/or cathode and protecting other tube components.

It has been discovered that during tube operation, the voltage potential distribution in the insulating structures created by the electric field existing between the anode and the cathode tends to concentrate near the high voltage source, in this case the anode and/or cathode. Among other things, this field concentration causes the overall voltage drop between the high voltage source and the vacuum enclosure to occur over a shorter distance of the insulating structure than the entire length thereof In other words, a portion of length of the insulating structure is not utilized to accommodate the necessary voltage drop between the anode and/or cathode and the enclosure. Several problems are created by this field concentration in the insulating structure. First, a waste of insulating structure occurs because a portion of the structure nearest the vacuum enclosure is not utilized. Worse, however, is an added per unit electric field stress that is imposed on the portion of the insulating structure nearest the anode and/or cathode, where the field concentration occurs. This electric field stress is highly undesirable because it may weaken over time the structural integrity of the x-ray tube. Eventually, the insulating structure may fail, causing substantial damage to the x-ray tube and requiring much time and expense to correct.

Various solutions have been attempted to resolve the effects caused by the electric field concentration near the anode and/or cathode. One attempted solution has involved increasing the size of the insulating structure near the anode and/or cathode in order to spread out the electric field concentration, and thus the electric field stress. Such a solution may be undesirable or impossible, however, given the tight space constraints present in many high voltage devices, especially x-ray tubes.

A need therefore exists to provide a manner by which electric field stress present in insulating structures of high voltage devices, such as x-ray tubes, may be mitigated. More generally, a need exists to enable the shaping of high voltage gradients along the length of an insulating structure in a high voltage device as may be desired by the operators of such devices.

BRIEF SUMMARY OF THE INVENTION

In accordance with the invention as embodied and broadly described herein, the foregoing needs are met by a method and apparatus for modifying the voltage potential distribution in insulating structures, or insulators, employed in high voltage devices. Preferred embodiments of the present invention are directed to altering the boundary conditions of the surfaces of insulating structures within x-ray tubes such that the voltage potential distribution along the length of the insulators extending from the anode and/or the cathode to the vacuum enclosure is shaped as may be desired for the particular application in which the tube is employed. The present invention may also be advantageously employed in a variety of other high voltage devices where shaping of the high voltage potential distributions along insulating structures disposed therein is needed or desired.

In a first embodiment, the voltage potential distribution is modified via a coating material non-uniformly applied to the surface of the anode and/or cathode insulator within an x-ray tube. The coating material has an electrical conductivity greater than that of the surface of the insulator. In addition, the coating material is non-uniformly applied in order to adjust the voltage distribution along length of the insulator from the anode or cathode to the vacuum enclosure surface. For instance, the thickness of the coating may be more thickly applied to the surface of the insulator nearest the cathode or anode than it is applied to than the portion nearest the vacuum enclosure surface. Or, the composition of the coating material may be altered such that it possesses greater conductivity where it is applied to the insulator surface nearest the cathode or anode. In this way, the desired voltage potential distribution gradient is achieved along the length of the insulator during operation of the x-ray tube.

In a second embodiment, the surface of an insulator is modified by preferential reduction of existing material (bulk or trace) using, for example, heating in a hydrogen atmosphere; electron (or ion) beam bombardment; or chemical means. For example, the surface of an anode insulator comprising leaded glass can be modified in order to change its conductivity. In one embodiment, this is accomplished by masking portions of the inner surface of the insulator, typically comprising a funnel or cone shape. The anode insulator is then heated in a furnace having a hydrogen-rich atmosphere, thereby causing a chemical reduction of lead oxide near the insulator surface. This reduction of lead oxide increases the amount of metallic lead near the surface of the insulator, which in turn increases the conductivity of the surface. This process is repeated for different regions of the insulator as desired in order to shape the overall conductivity of the insulator surface. As with the first embodiment, this enhances the ability of the insulator surface to more evenly distribute the voltage potential along the length thereof during tube operation. Similarly, sodium or potassium could be reduced from alumino-ortho-silicate glasses. In other examples, Boron or sodium could be reduced from "Pyrex" glass, or calcium, strontium and other metallic oxides could be reduced from the glassy phase of ceramic materials or from oxide glasses. Preferential reduction of the bulk ceramic material (such as reducing aluminum to aluminum, or silicon from silica ceramics) could also be accomplished by similar means.

It will be appreciated that the insulator surface conductivity can be modified by other means, such as preferential reduction as required. Deposition of a metallic overcoating on the insulator surface, and subsequent preferential oxidation of the metallic overcoat could also achieve the desired surface conductivity. The conductivity of insulating materials may also be modified by preferential ionic transport through the insulating material through the use of electric fields in conjunction with heating. Similar methods may also be used for grading of properties of the insulator.

In a third embodiment, an insulating structure having a smooth, continuously connecting surface is coated on at least a portion of its continuous surface with a conductive coating material similar to the material employed in the first embodiment. The coated surface is then scribed via a laser or the like to form a groove on the coated surface extending down to the surface of the insulator. This creates a conductive path along the surface of the insulator having a defined voltage gradient as characterized by the shape and path of the scribed groove. In this way, the voltage potential along the insulating length of the insulator surface is more evenly distributed.

In a fourth embodiment, the insulating structure comprises a plurality of material segments that have been joined together to form the insulator. The segments are preferably assembled by sintering and furnace heating, then shaped into the final insulator form. Each insulator segment preferably possesses a distinct electrical conductivity so that, when assembled, the insulator defines a non-uniform surface conductivity that modifies and more evenly distributes the voltage potential distribution along the insulator surface during operation of the high voltage device.

The above embodiments of the present invention enable the voltage potential distribution to be modified along the insulating length by adjusting the surface conditions of the insulator, namely, the conductivity thereof. In so doing, the problems associated with field concentration near the high voltage source may be avoided by adjusting the conductivity of the insulator such that the voltage distribution is spread more evenly along the insulator length. This, in turn, avoids complications with electric field stress arising from the concentration of the electric field near the high voltage structure. This benefit is especially useful for x-ray tubes, where the effects of the electric field stress may eventually cause catastrophic failure of the insulator and the entire tube as well.

These and other objects and features of the present invention will become more fully parent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made to figures wherein like structures will be provided with like reference designations. It is understood that the drawings are diagrammatic and schematic representations of presently preferred embodiments of the invention, and are not limiting of the present invention nor are they necessarily drawn to scale. FIGS. 1–7 depict several embodiments of the present invention, which is directed to apparatus and methods for enabling the voltage potential distribution of an insulator in a high voltage device to be modified along the insulating length thereof by adjusting the surface conditions of the insulator, such as its conductivity. Preferred embodiments of the present invention as described below are directed to modification of the surfaces of insulators disposed within x-ray tubes, though it is emphasized that the present invention may be advantageously employed in a variety of high voltage devices utilizing insulating surfaces.

Figure 1:
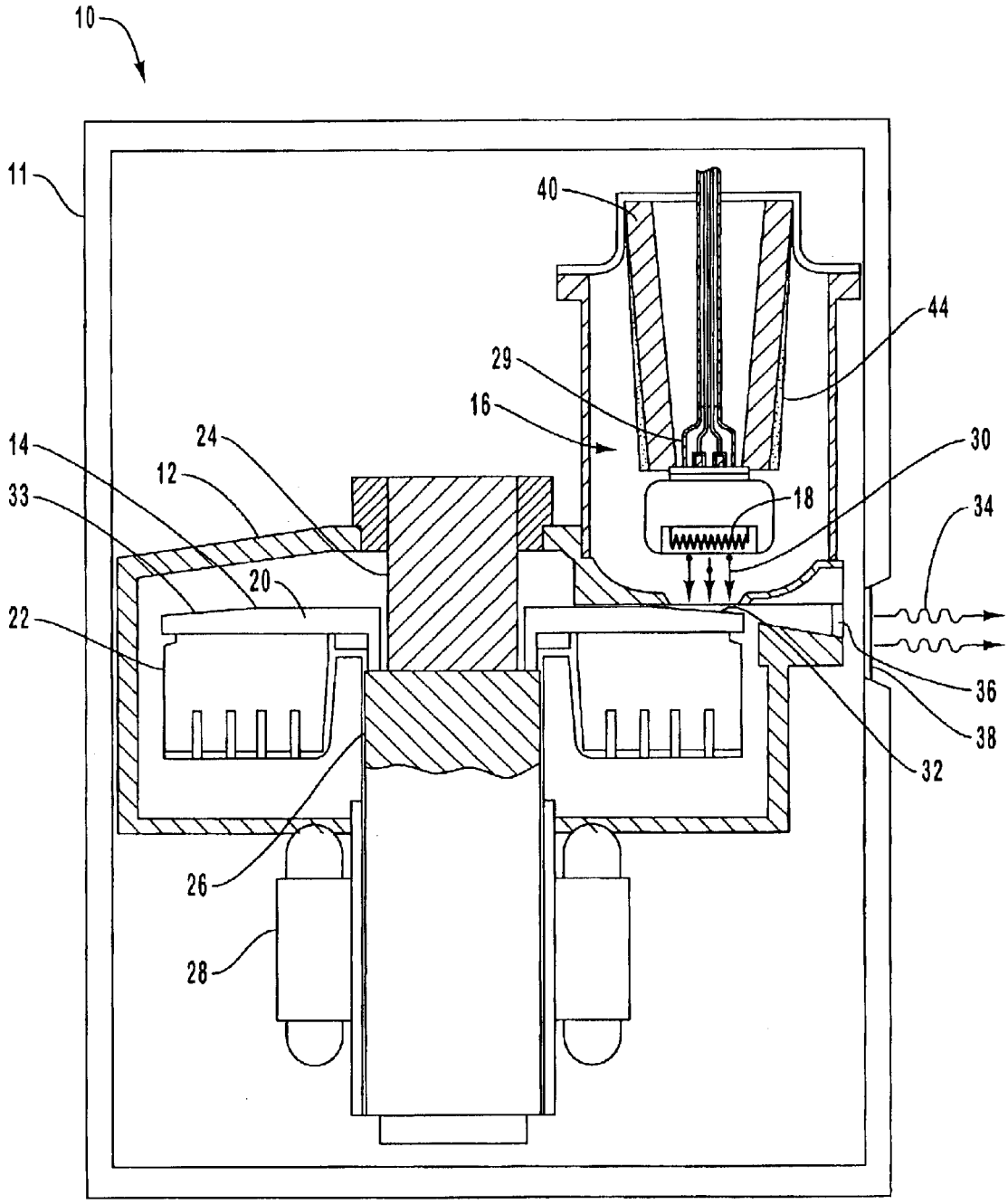
FIG. 1 is a cross sectional side view of one type of x-ray tube having an insulating structure configured in accordance with one embodiment of the present invention.

Reference is first made to FIG. 1, wherein is depicted a single-ended x-ray tube 10. The x-ray tube 10 preferably includes an outer housing 11 and a vacuum enclosure 12 disposed within the housing 11. A rotary anode 14, and a cathode 16 are disposed inside the vacuum enclosure 12. The anode 14 is spaced apart from and oppositely disposed to the cathode 16 in such a way as to be positioned to receive electrons emitted by a filament 18 disposed in the cathode. A target surface 20 typically comprising TZM (an alloy of titanium, zirconium, and molybdenum) is disposed on a graphite substrate 22 of the anode 14. The anode 14 is rotatably supported by a support stem 24 and a bearing assembly 26, and it is rotated during tube operation by motor, such as a stator 28.

The operation of the single-ended x-ray tube 10 is well known. The cathode 16 is electrically biased via a high voltage cable 29 such that a high voltage differential is established between the cathode and the anode 14. For example, the cathode 16 is biased with a high negative electric potential, or voltage (such as −150 kV), while the anode 14 is maintained at a low voltage, referred to as housing or ground potential. An electric current is then passed through the filament 18, thereby causing a cloud of electrons, designated at 30, to be emitted from the filament by a process known as thermionic emission. An electric field caused by the high voltage differential between the anode 14 and the cathode 16 causes the electron stream 30 to accelerate from the cathode toward a focal spot 32 located on the target surface 20 of the anode, where the anode is caused to rotate at a high rate of revolution by the stator 28. As can be seen in FIG. 1, the focal spot 32 is the point at which the electrons 30 impact the target surface. As the anode 14 rotates under the electron stream 30 during tube operation, the focal spot is occupied by successive portions of the target surface 20. These portions are collectively referred to as the focal track 33. As they accelerate toward the focal spot 32, the electrons 30 gain a substantial amount of kinetic energy. Upon approaching and impacting focal spot 32 of the anode target surface 20, many of the electrons 30 convert their kinetic energy and either emit, or cause to be emitted from the target surface, electromagnetic waves of very high frequency, i.e., x-rays. The resulting x-rays, designated at 34, emanate from the anode target surface 20 and are then collimated first through a window 36 disposed in the vacuum enclosure 12, then through a window 38 disposed in the outer housing 11. The collimated x-rays 34 are directed for penetration into an object, such as an area of a patient's body. As is well known, the x-rays 34 that pass through the object can be detected, analyzed, and used in any one of a number of applications, such as x-ray medical diagnostic examination or materials analysis procedures.

Figure 2:
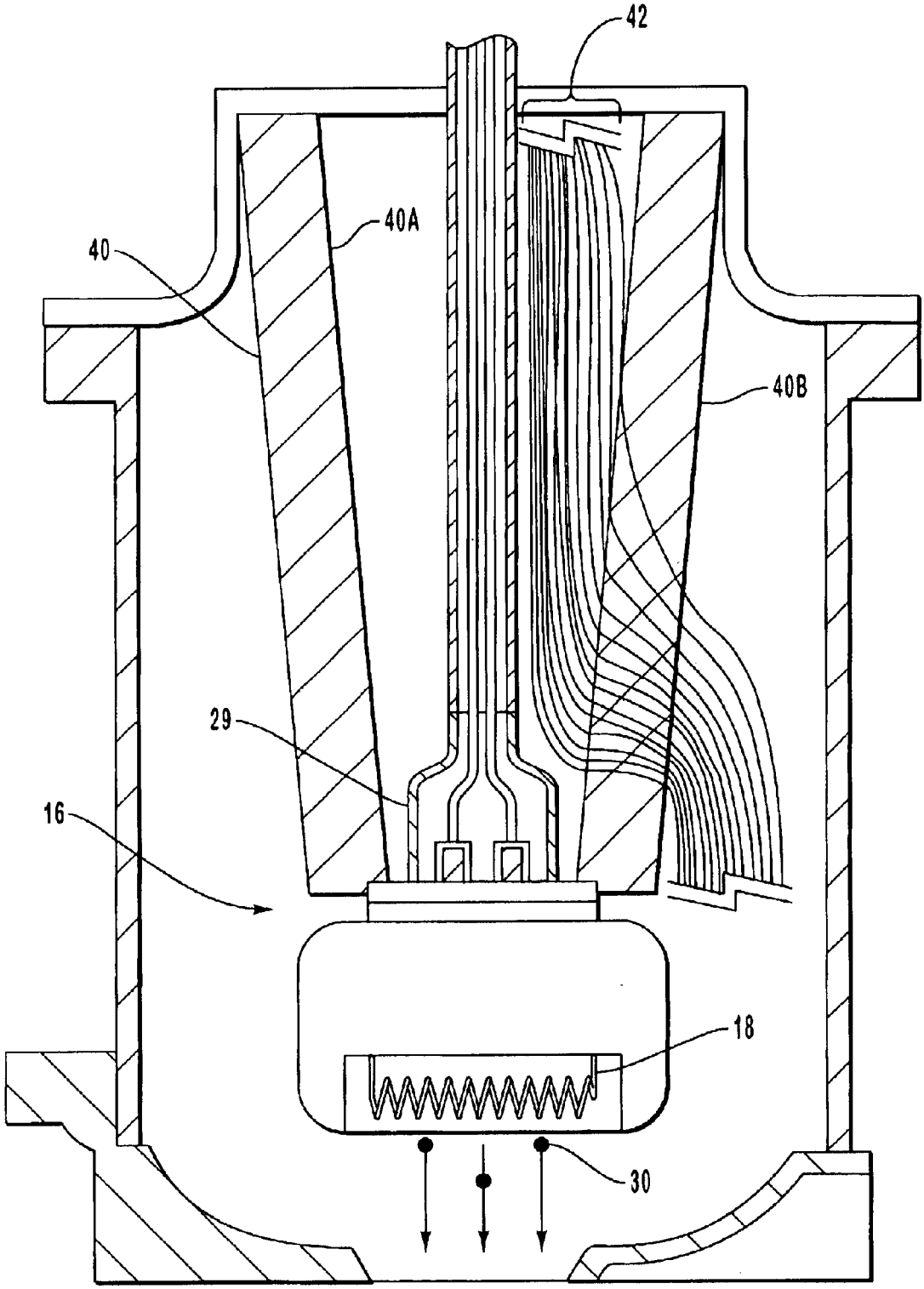
FIG. 2 is cross sectional side view of a cathode insulator of an x-ray tube, depicting equipotential lines associated with the electric field present during operation of the tube.

Reference is now made to FIG. 2, which depicts a portion of the x-ray tube 10 near the cathode 16 during tube operation. The cathode 16 in the single-ended x-ray tube 10 is structurally supported by an insulating cathode cone 40. The cathode cone 40 typically comprises a cone shape having open ends and is composed of a ceramic material. It is affixed to, and also comprises a portion of, the vacuum enclosure 12, thereby supporting the cathode 16 in a position where the electrons 30 may be efficiently emitted by the filament 18 toward the anode 14. As part of the vacuum enclosure 12, the cathode cone 40 comprises an inner surface 40A, and an outer vacuum surface 40B, which is exposed to the vacuum maintained by the vacuum enclosure.

As mentioned above, the high negative voltage applied to the cathode 16 via the high voltage cable 29 creates an electric field between the cathode and the anode 14 during tube operation. This electric field is figuratively represented in FIG. 2 by equipotential lines 42 that connect portions of the electric field having equal voltages. This shape of the equipotential lines 42, and hence the electric field, is created in part by several factors, including the composition of the insulating structure, the placement of other structures surrounding the high voltage component, and the voltage applied to the high voltage component.

In addition to supporting the cathode structure, the cathode cone 40 acts as an insulating structure for the cathode 16. The cathode cone 40, therefore, is responsible for electrically isolating the cathode 16 and its associated electric field from the other portions of the x-ray tube 10. Thus, the cone is comprised of an insulating material such as ceramic or glass such that the electric field dissipates in the ceramic material as a function of distance from the high voltage source (in this case, the cathode 16). Hence, the voltage present at the end of the cone nearest the surface of the vacuum enclosure to which the cone is attached is at a non-destructive low voltage level, known as housing potential. The dissipation of the electric field can be seen in FIG. 2, where the equipotential lines corresponding to portions of the field having the highest voltage are located nearest the cathode 16, while the lower voltage portions of the field are located toward the end of the cathode cone that is attached to the vacuum enclosure 12.

Also visible in FIG. 2 is the concentration toward the high voltage cathode 16 of the electric field along the outer vacuum surface 40B of the insulating cathode cone 40. This field concentration is manifested by the equipotential lines 42, which represent the voltage distribution of the electric field about the cathode 16 during operation of the x-ray tube 10, that are tightly grouped along the outer vacuum surface 40B near the cathode 16. Such field concentration typically occurs on the insulators of x-ray tubes and other high voltage devices and, as explained above, is highly undesirable. Embodiments of the present invention are directed toward resolving this problem.

Figure 3:
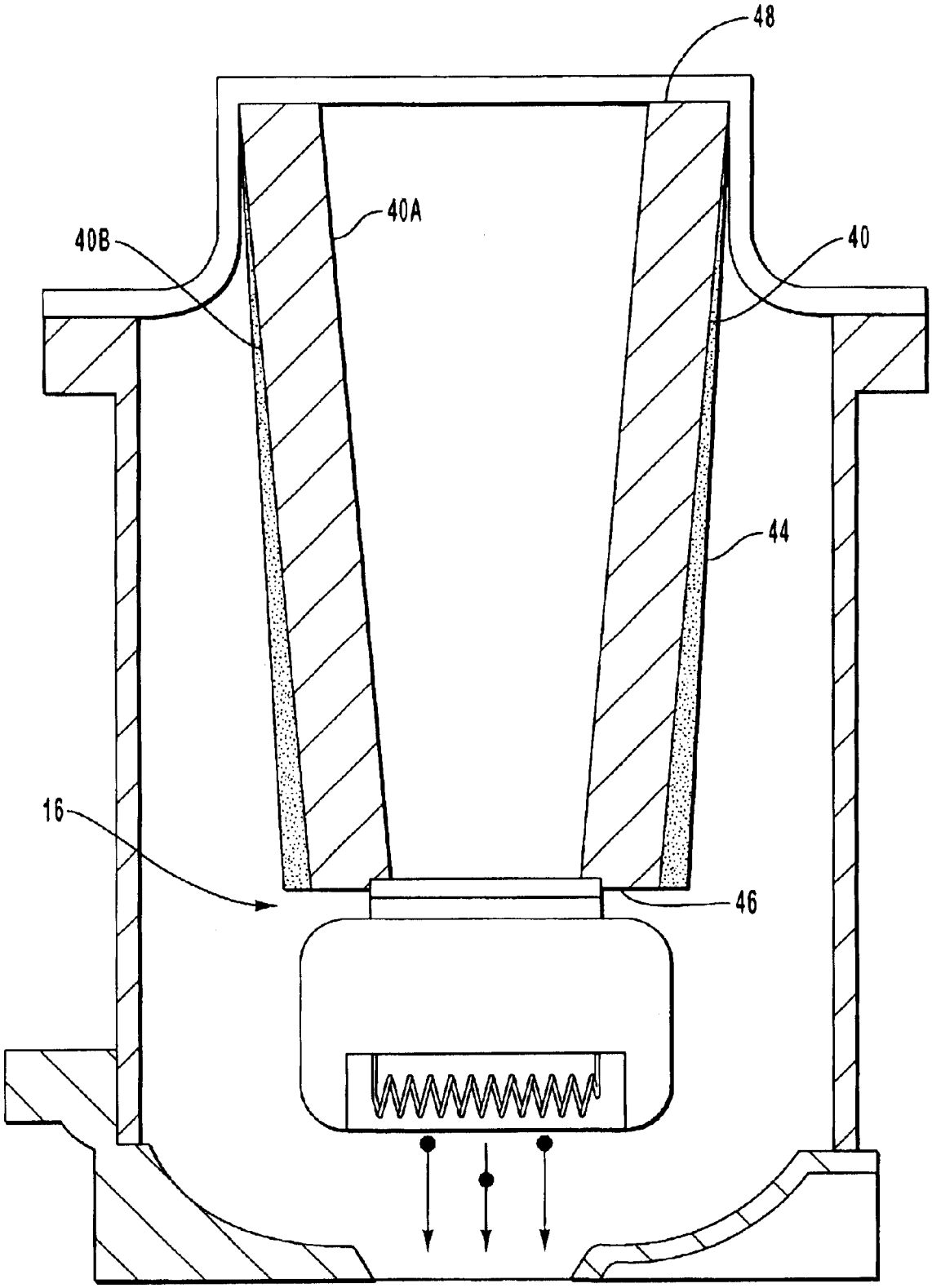
FIG. 3 is a cross sectional side view of a cathode insulator having disposed thereon a coating material in accordance with a first embodiment of the present invention.

Attention is now directed to FIG. 3, which depicts a portion of the x-ray tube 10 near the cathode 16. In accordance with a first embodiment of the present invention, the outer vacuum surface 40B of the insulating cathode cone 40 has disposed thereon a non-uniform coating material 44. The coating material 44 is used to modify the voltage potential distribution of the electric field along the surface of the cone vacuum surface 40B during tube operation, as explained further below. To that end, the coating material 44 is sufficiently electrically conductive with respect to the insulating material in order to enable it to modify the voltage distribution. Accordingly, the electrically conductive coating material 44 is understood to comprise one of a variety of conductive, semi-conductive, and semi-insulating substances including, but not limited to carbon, silver, copper, nickel, chromium, etc. Alternatively, the coating material 44 could comprise two or more materials applied to the cone vacuum surface 40B as a mixture, or separately applied to different areas of the vacuum surface, to perform the same function as described further below.

The coating material 44 is applied lo the cone vacuum surface 40B such that it possesses non-uniform characteristics. For example, and as illustrated in FIG. 3, the thickness of the coating material 44 (which has been exaggerated in the figure for clarity) is greatest on the surface 40B nearest the cathode 16, designated as the first end 46 of the cathode cone 40, and thinnest nearest the point where the cathode cone 40 joins the adjacent portion of the vacuum enclosure 12, designated as the second end 48 of the cone. This relative variation in coating thickness yields a corresponding variation in the conductive path defined by the coating material along the insulating length of the cathode cone outer vacuum surface 40B, which in turn enables modification of the voltage potential distribution along the vacuum surface to take place during tube operation, as explained further below. It is noted that in this embodiment, the insulating length of the cone 40, which is the length of the insulator over which the high voltage of the cathode 16 may be dissipated, extends from the first end 46 to the second end 48 of the cone.

The depth range to which the coating material 44 is applied on the outer vacuum surface 40B is a function of the composition of the coating material. For instance, a coating material having a relatively high electrical conductivity is preferably applied in a thinner overall thickness to the cone vacuum surface 40B. Conversely, semi-conducting and semi-insulating coating materials are applied to a greater overall thickness. The thickness range for all usable coating materials, however, preferably varies between about 0 and 2/100ths of an inch.

The application of the coating material 44 is accomplished by known techniques, such as chemical or physical vapor deposition, sputtering, flame spraying, or simple painting processes.

Figure 4:
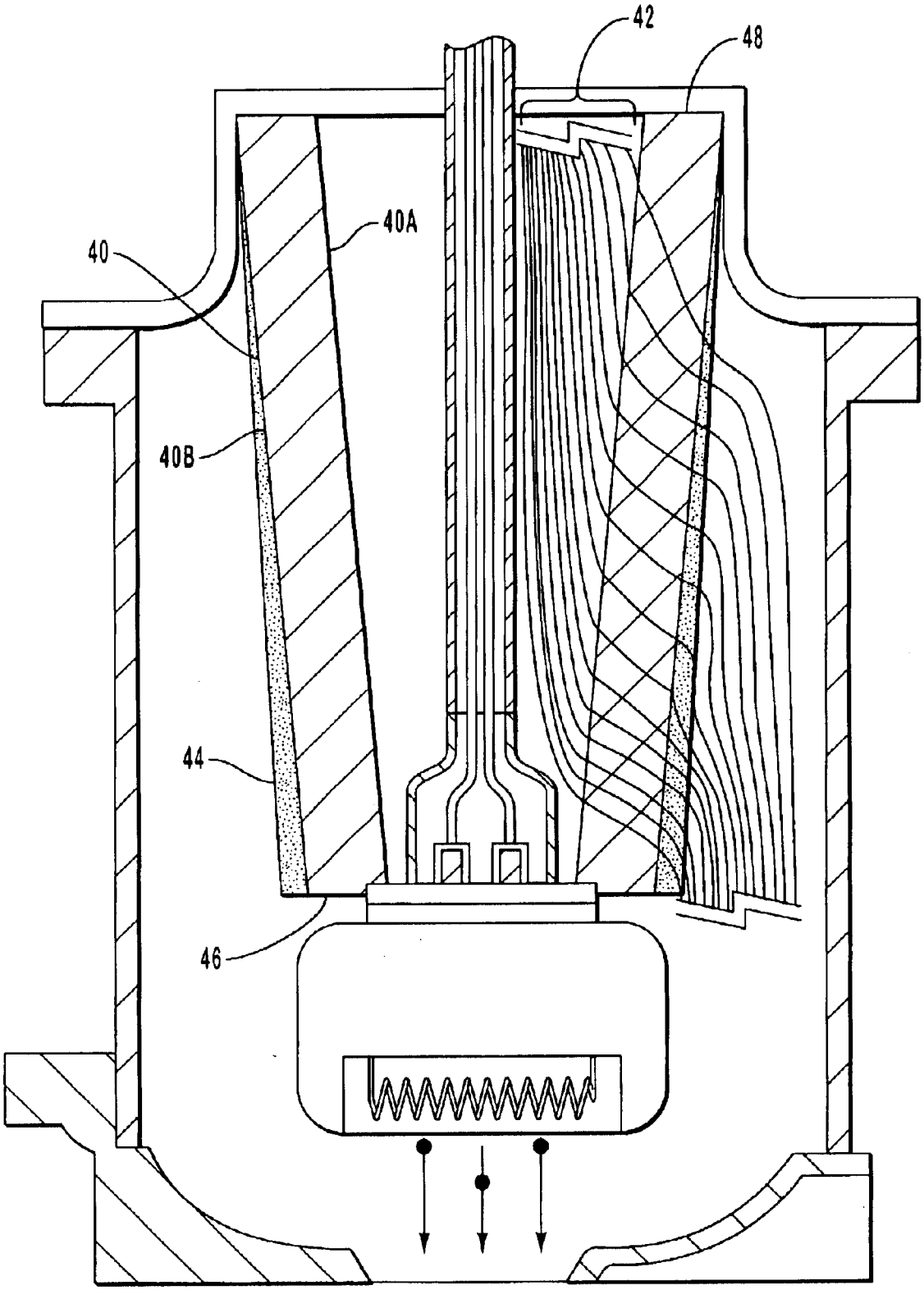
FIG. 4 is a cross sectional view of the cathode insulator of FIG. 3, depicting the equipotential lines as modified by the first embodiment of the present invention.

Reference is now made to FIG. 4, which depicts the equipotential lines 42 about the cathode area of the x-ray tube 10 during operation after application of the coating material 44 to the cathode cone 40. The presence of the coating material 44 on the cone vacuum surface 40B enables the voltage distribution along the surface thereof to be adjusted without defeating the insulating properties of the cone, thereby enabling problems created by the concentration of electric field on the cone surface near the cathode 16 during the operation of the x-ray tube 10 to be overcome. Because the coating material 44 increases the conductivity of the cone vacuum surface 40B, the electric charges associated with the voltages represented by the equipotential lines 42 are more able to migrate along the relatively more conductive surface of the cone, thereby spreading out the equipotential regions and decreasing the concentration of field voltages near the cathode 16, as seen in FIG. 4. The extension of the equipotential lines 42 is limited by the thinning of the coating material 44 near the second end 48 of the insulating cathode cone 40, thereby preserving the ability of the cone to fully electrically isolate the cathode from other portions of the x-ray tube. In this way, the voltage distribution along the surface of the cathode cone may be adjusted as desired or needed by varying the physical characteristics of the coating material 44. Preferably, the voltage potential distribution is adjusted such that the per unit electric field stress on portions of the cathode cone 40 near the first end 46 is reduced as described above, thereby reducing the likelihood of damage to the cone.

The coating material of the first embodiment of the present invention described above is but one example of the use of coating materials on a portion of an insulating surface in a high voltage device for modifying the voltage distribution thereon. Indeed, variations on the embodiment described above are appreciated. For example, the thickness of the coating material could vary in a manner not specified above. Or, a portion of the cathode cone or insulative structure other than the vacuum surface could be coated by the material. As mentioned above, two or more substances could be mixed to form the coating material, or the two or more substances could each coat distinct areas of the insulating structure, thereby imparting to each area of the structure a distinct electrical conductivity. Or, the distinct coatings could be selectively overlapped on the insulating structure surface in order to customize the desired conductivity on the surface. Of course, a portion less than the entire surface of the vacuum surface of the cathode cone could be coated, if desired. Finally, and as mentioned above, the disclosure of this or other embodiments is not limited solely for use with the x-ray tube type shown in FIG. 1, or for use only with x-ray tubes in general, but may be advantageously employed in a variety of high voltages devices.

Figure 5:
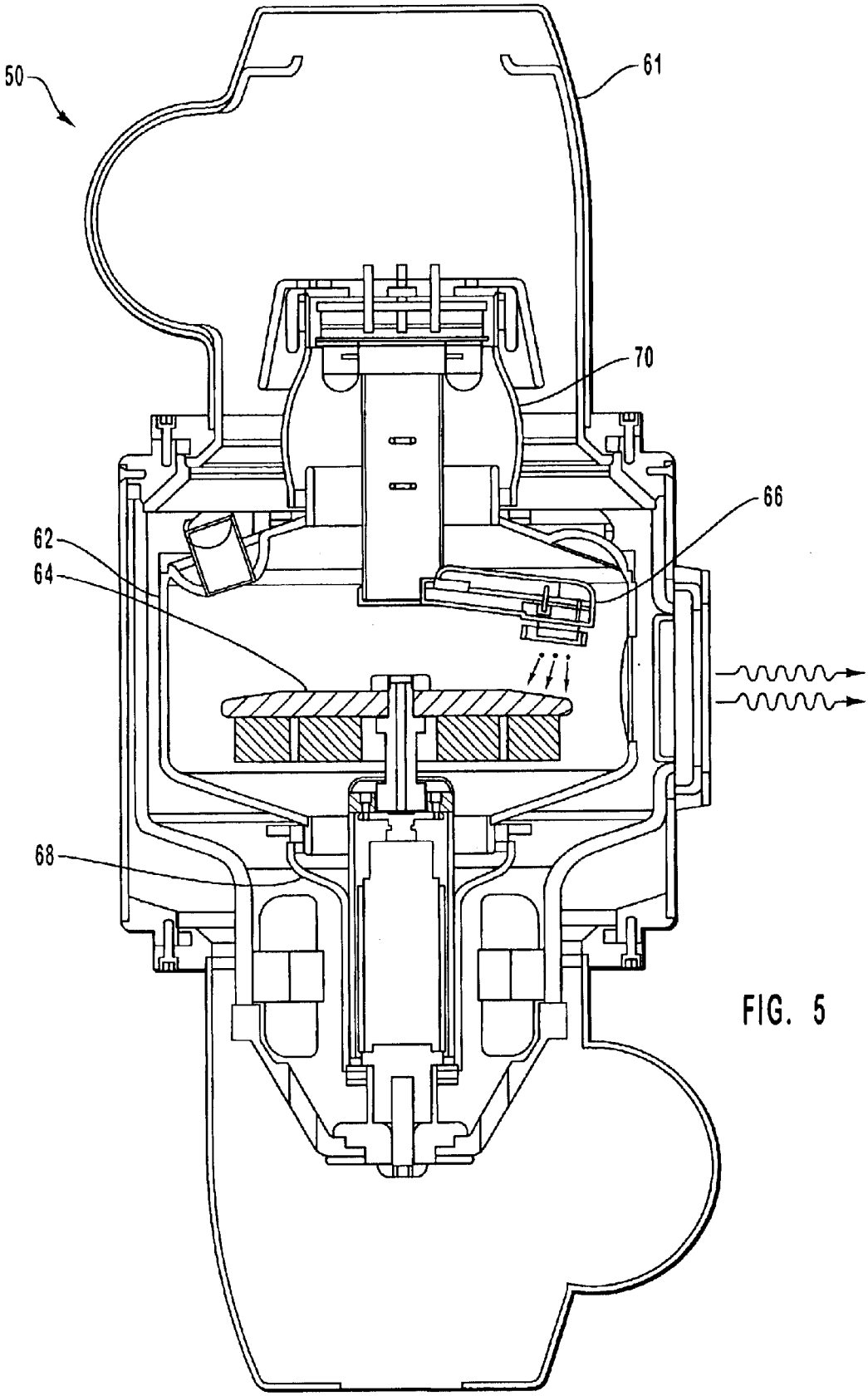
FIG. 5 is a cross sectional side view of another type of x-ray tube having insulating structures configured in accordance with embodiments of the present invention.

Reference is now made to FIG. 5, which depicts another type of x-ray tube that may benefit from the present invention. FIG. 5 illustrates a double-ended x-ray tube 50 which, like the single-ended tube 10, comprises an outer housing 61 in which is disposed a vacuum enclosure 62. A rotary anode 64 and a cathode 66 are disposed within the vacuum enclosure 62. In contrast to the single-ended x-ray tube 10 of FIG. 1, both the cathode 66 and the anode 64 are biased with a high voltage. In a typical double-ended tube, the anode 64 may be biased with a voltage of +75 kV, and the cathode may be biased with a voltage of −75 kV. Because of this biasing, both components must be electrically isolated from the rest of the x-ray tube by insulating structures. Insulators 68 and 70 insulate the anode 64 and the cathode 66, respectively. Composed of glass, ceramic, or other insulating material, the anode and cathode insulators 68 and 70 also comprise portions of the vacuum enclosure 62.

In a manner similar to that described above, both the anode insulator 68 and the cathode insulator 70 may be non-uniformly coated with a coating material in order to more evenly distribute the voltage potential along the surfaces thereof. The coating material would preferably be applied to the inner vacuum surfaces 68A and 70A of the insulators 68 and 70, respectively, in a manner consistent with that described above for coating portions of a single-ended x-ray tube 10. In this way, the voltage potential distribution along the insulator 68 and/or 70 is equalized, thereby reducing electric field stress near the high voltage ends of the insulators while still allowing for effective electrical isolation of the rotary anode 64 and the cathode 66 from the rest of the x-ray tube 60.

Figure 6:
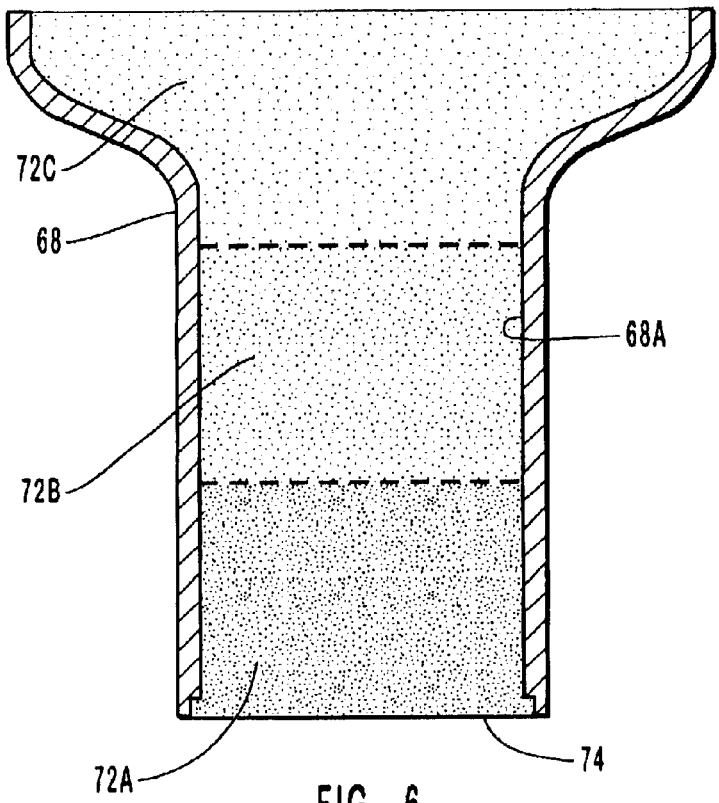
FIG. 6 is a cross sectional side view of an anode insulating cone from the x-ray tube of FIG. 5, depicting details of a second embodiment of the present invention.

Attention is now directed to FIG. 6, depicting in cross section the anode insulator 68 of the double-ended x-ray tube 60 of FIG. 5. FIG. 6 depicts the anode insulator 68 prepared for use in the x-ray tube 60 in accordance with a second embodiment of the present invention. In this embodiment, the surface of the insulating structure itself is modified in a non-uniform manner to enable a more even voltage potential distribution to exist along the surface thereof during tube operation. For example, an anode insulator 68 composed of leaded glass is provided. A first region 72A of the inner vacuum surface 68A remains uncovered while the rest of the inner surface in masked with a heat resistant covering. The anode insulator 68, and particularly the inner vacuum surface 68A, is then fired in a hydrogen-rich atmosphere for a time sufficient to partially chemically alter the unmasked portions of the leaded glass inner vacuum surface 68A in accordance with the following chemical reaction:

$$PbO_2+4H^+ +2e^- = Pb^{2+}+2H_2O$$

The above reaction reduces the amount of lead oxide present at or near the inner surface 68A, and increases the amount of pure lead located there, which in turn increases the conductivity of the inner surface. The above masking and firing process is then repeated, but with the first region 72A and a new second region 72B of the inner vacuum surface 68A remaining uncovered while the rest of the inner surface is masked. After the second firing of the anode insulator 68 in the hydrogen-rich atmosphere, the second portion of the inner surface 68A possesses an increased concentration of conductive lead atoms, while the first portion possesses an even higher pure lead concentration.

The above masking/firing process may be repeated one or more times as desired to form successive regions on the inner vacuum surface 68A having electrical conductivities that vary in accordance with the concentration of lead atoms contained in the region. For instance, FIG. 6 shows three regions 72A, 72B, and 72C, each having a distinct and successively less conductive surface, disposed on the inner vacuum surface 68A of the anode insulator 68. This surface was produced by three masking/firing iterations using the above-described method. The first region 72A, being most conductive as a result of remaining uncovered during the three masking/firing iterations, is chosen to be situated nearest a first end 74 of the anode insulator 68 where high voltage emanating from the rotary anode 64, and thus electric field stress associated with the electric field concentration, is greatest. In contrast, the second and third regions 72B and 72C are less conductive than the first region 72A as a result of being uncovered for only two and one masking/firing iterations, respectively. In this way, the voltage potential distribution along the inner vacuum surface 68A of the insulator 68 is more evenly shifted away from the high voltage end of the insulator near the first region 72A during tube operation, in accordance with the aims of the present invention.

It is appreciated that the method for modifying the surface properties of the insulator in a non-uniform manner of the second embodiment above may be employed using insulators other than the anode insulator of an x-ray tube as illustrated in FIG. 6. Indeed, insulators of various shapes and compositions could benefit from the practice of the principles contained in the present disclosure. Moreover, other physical or chemical processes may be used to alter the conductivity characteristics of the insulator surface. Accordingly, such other methods are understood as residing within the claims of the present invention.

Figure 7:
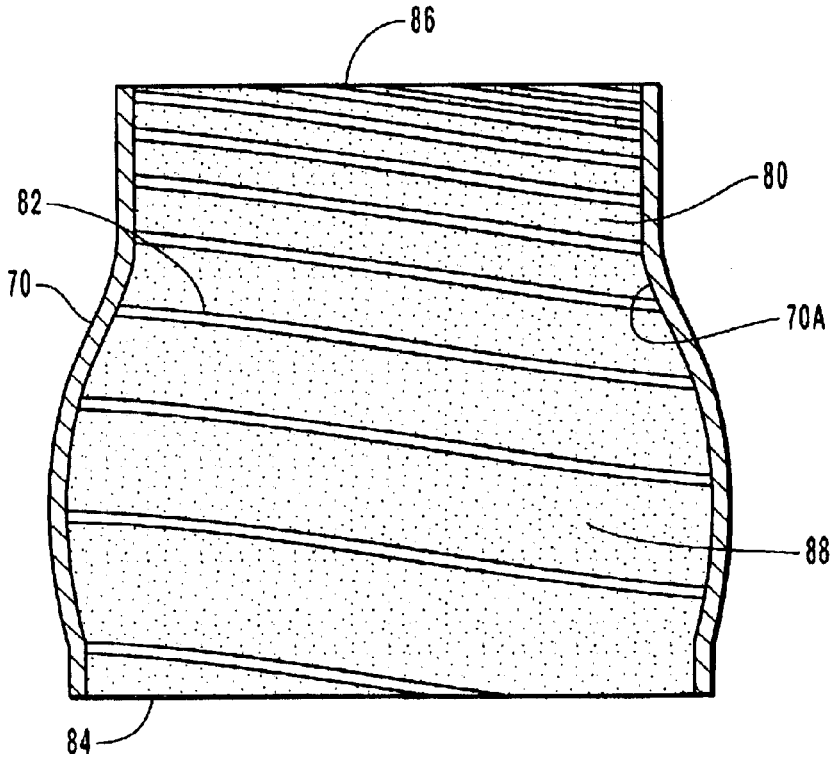
FIG. 7 is a cross sectional side view of a cathode insulating cone from the x-ray tube of FIG. 5, depicting details of a third embodiment of the present invention.

Reference is now made to FIG. 7, which depicts in cross section the cathode insulator 70 of the double-ended x-ray tube 60 of FIG. 5. FIG. 7 depicts the cathode insulator 70 prepared for use in the x-ray tube 60 in accordance with a third embodiment of the present invention. In this embodiment, an electrically conductive pattern is defined on the surface of the insulating structure to create a more even voltage potential distribution along the surface during tube operation.

As can be seen in the cross sectional view of FIG. 7, the inner vacuum surface of the cathode insulator 70, designated as 70A, has disposed thereon a layer of coating material 80 through which has been scribed a path 82. The coating material 80 is preferably a conductive, semi-conductive, or semi-insulating coating similar to the coating material 44 described in the first embodiment. As such, the coating material 80 may comprise the same materials as the coating material 44, and may be applied using those techniques described in the first embodiment above for applying the coating material 44. Preferably, the coating material 80 is equally applied to the inner vacuum surface 70A of the cathode insulator 70 such that the thickness of the coating along the inner surface is uniform. The path 82 is then scribed about the coated inner surface 70A. The scribing may be accomplished using a laser or other instrument capable of continuously penetrating the coating material 80. The depth of the path 82 is sufficient to penetrate through the thickness of the layer of coating material 80 and expose the underlying inner vacuum surface 70A.

The scribed path 82 preferably defines a helical path about the inner vacuum surface 70A of the cathode insulator 70. The path 82 extends from a first end 84 of the cathode insulator 70 to a second end 86. So disposed, the scribed path 82 accordingly defines a conductive route 88 in the coating material 80 between adjacent turns of the scribed path. Preferably, the spacing of the turns of the helix formed by the scribed path 82 varies as a function of length along the inner vacuum surface 70A between the first and second ends 84 and 86. Fewer turns of the scribed path 82 per given length are preferably defined in the coating material 80 nearest the high voltage first end 84 of the cathode insulator 70 than are defined in the middle region of the insulator and/or toward the lower voltage second end 86 thereof. Fewer turns of the scribed path 82 per given length of the inner vacuum surface 70A of the cathode insulator 70 creates less voltage drop nearest the high voltage first end 84 of the cathode insulator 76, which equates to less electric field stress in that region. Similarly, more turns of the scribed path 82 per given length of the insulator 70 in the middle region and near the second end 86 of the cathode insulator 70 equate to a higher magnitude of voltage drop, thereby providing a more equal voltage distribution over the inner vacuum surface 70A during tube operation than would otherwise be present.

As an alternative to varying the turn spacing of the scribed path 82, the width of the scribed path itself could be varied along the length thereof. In altering the width of the scribed path, the width of the conductive route 88 is also necessarily altered, which provides the same effect on the distribution of the voltage potential of the electric field as does the turn spacing variation described above.

It is appreciated here that the scribed path 82 need not conform to the spacing/shaping characteristics described above. Indeed, the path 82 could assume a different turn density configuration as may be appreciated by one of skill in the art. Moreover, the path 82 need not define a helical shape but could define another pattern. In lieu of a groove defined by the path 82, the same functionality could be provided by a path of resistive material 80 inlaid in a pattern into the coating material 80 as applied to the inner vacuum surface 70A. Also noted is the fact that not all of the inner vacuum surface 70A of the cathode insulator need be coated and/or scribed with the coating material 80 and the scribed path 82, respectively. As mentioned before, the present embodiment may also be applied to a variety of high voltage insulators having a continuous surface on which a scribed path could be defined.

Figure 8:
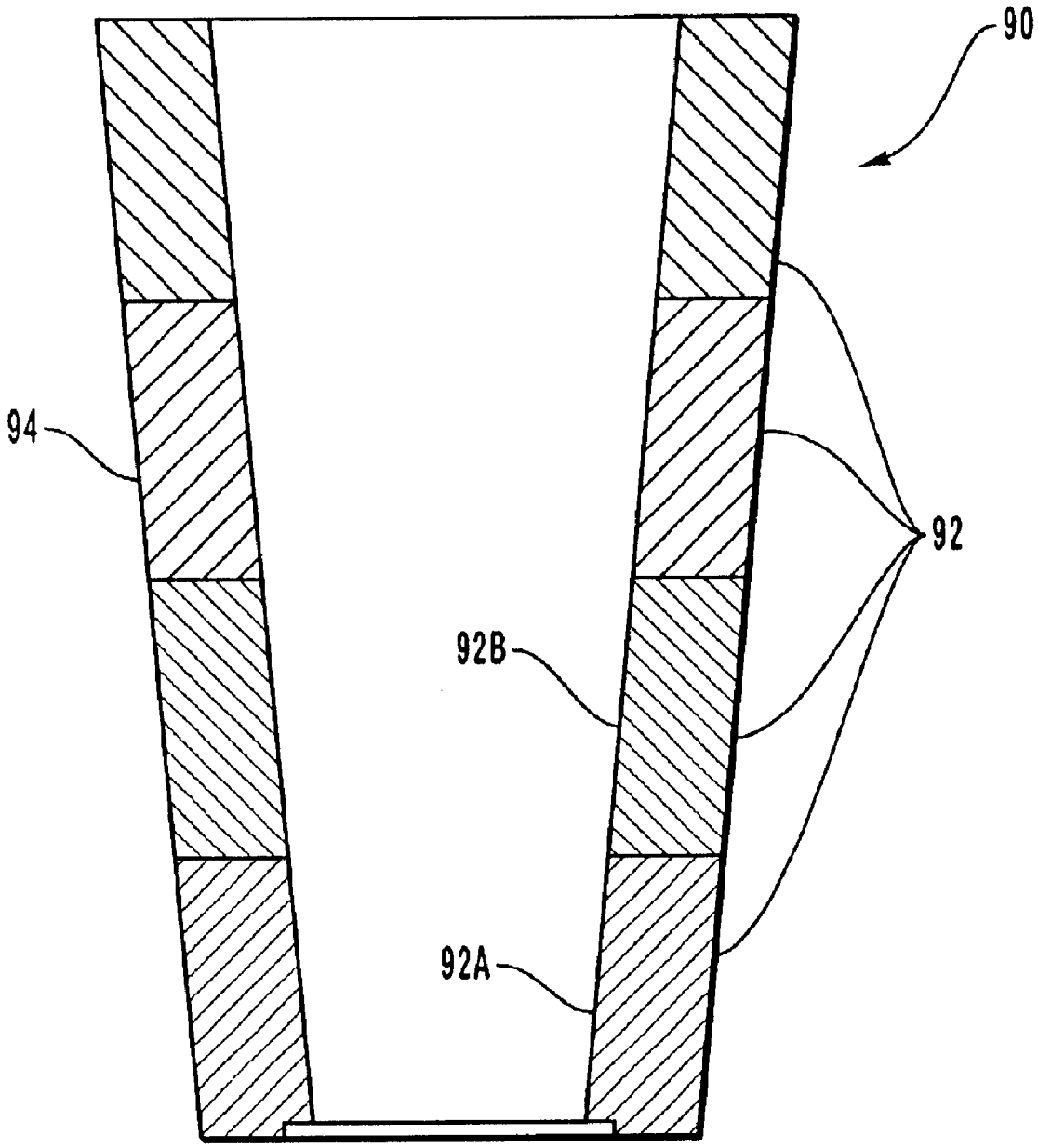
FIG. 8 is a cross sectional side view of a cathode insulating cone of the x-ray tube of FIG. 1, depicting details of a fourth embodiment of the present invention.

Attention is now directed to FIG. 8, wherein is depicted a cathode cone 90 for use in a single-ended x-ray tube 10 as shown in FIG. 1. The cathode cone 90 is manufactured in accordance with a fourth embodiment of the present invention in order to provide an outer vacuum surface having varying electrical conductivity in order to more evenly distribute voltage potentials along that surface during tube operation. As is the case with the above embodiments, the disclosure discussed herein in connection with this embodiment may also be applied to other high voltage devices utilizing insulating structures.

The cathode cone 90 is preferably manufactured from two or more segments 92 of insulating material, with each segment possessing a distinct electrical conductivity. For instance, the segments 92 may be aligned such that each portion has a slightly lower conductivity than the portion adjacent to it. The cathode cone 90 shown in FIG. 8 comprises four segments 92 of insulating material. The segments 92 may be shaped into their final form either before or after joining. The segments 92 are joined to one another using known joining techniques such as sintering, then furnace firing. The joining technique used should ensure that the bond between adjacent segments 92 is hermetic such that the cathode cone 90 may comprise a portion of the vacuum enclosure of the x-ray tube. After the sintering and firing (or similar joining procedure) is complete, final shaping of the joined segments 92 may occur if needed to form the cathode cone 90.

As mentioned above, the electrical conductivity of each segment 92 preferably varies with respect to the other segments 92 comprising the cathode cone 90. In the cone 90 illustrated in FIG. 8, for example, the segment 92A has a higher conductivity than does the segment 92B, and so on. In this way, the conductivity of the outer vacuum surface 94 varies along the length thereof. This, in turn, enables the voltage potential distribution caused by the electric field about the cathode cone 90 during tube operation to be more evenly spread along the surface of the outer vacuum surface 94, which, as stated before, lessens the incidence of electric field stress near the high voltage region of the cathode cone 90, thus improving the operating lifetime of the insulating structure and x-ray tube or other high voltage device.

Each of the above embodiments is designed to reduce or eliminate the effects caused by electric field stress in the portions of insulating structures nearest high voltage sources in high voltage devices, such as x-ray tubes. This beneficial result may be seen in FIG. 4, where by modifying the surface conditions of the insulating structure, namely the electrical conductivity thereof, the distribution of voltage potential along the surface of the modified insulating structure is more even, thereby reducing the concentration of field voltages near the high voltage end of the insulating structure. Though FIG. 4 depicts the spreading of the voltage equipotential lines 42 along the surface of the cathode cone 40 coated with a coating material 44 in accordance with the first embodiment of the present invention, similar results are obtained with each of the present embodiments described herein.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. An x-ray tube comprising:

a vacuum enclosure having disposed therein a cathode for producing electrons, and an anode positioned to receive electrons emitted by the cathode;

a cathode insulating structure affixed to the cathode for electrically isolating the cathode from other portions of the x-ray tube;

an anode insulating structure affixed to the anode for electrically isolating the anode from other portions of the x-ray tube; and means for modifying the voltage potential along the surface of at least one of the insulating structures of the x-ray tube during operation thereof.

2. An x-ray tube as defined in claim 1, wherein the means for modifying the voltage potential comprises a layer of electrically conductive coating material applied to the surface of at least one of the insulating structures of the x-ray tube such that the thickness of the layer as applied to the surface varies as a function of position on the surface of the at least one insulating structure.

3. An x-ray tube as defined in claim 1, wherein the insulating structure affixed to the anode comprises a cylindrical surface.

4. An x-ray tube as defined in claim 1, wherein the insulating structure affixed to the cathode comprises a cylindrical surface.

5. An x-ray tube as defined in claim 3 or 4, wherein the means for modifying comprises:

a layer of electrically conductive coating material applied to the cylindrical surface of the insulating structure, the coating material having an electrical conductivity greater than the material comprising the insulating structure; and a helical groove defined in the layer of coating material such that a portion of cylindrical surface of the insulating structure is exposed by the groove, the helical groove being defined in the layer of coating material such that the spacing between adjacent turns of the helical groove varies as a function of position along the cylindrical surface of the insulating structure.

6. An x-ray tube as defined in claim 5, wherein the spacing between adjacent turns of the helical groove is greater nearest the anode or the cathode.

7. An x-ray tube comprising:

a vacuum enclosure having disposed therein a cathode for producing electrons and an anode positioned to receive the electrons emitted by the cathode;

a cathode insulator for electrically isolating a high voltage potential produced by the cathode from other portions of the x-ray tube;

an anode insulator for electrically isolating a high voltage potential produced by the anode from other portions of the x-ray tube; and a layer of coating material applied in a non-uniform fashion to the surface of at least one of the cathode and anode insulators for modifying the voltage potential along the surface thereof.

8. An x-ray tube as defined in claim 7, wherein the layer of coating material is applied to the cathode insulator, the layer being applied such that the layer is thickest near the end of the cathode insulator that is closest to the high voltage potential produced by the cathode.

9. An x-ray tube as defined in claim 7, wherein the layer of coating material is applied to the anode insulator, the layer being applied such that the layer is thickest near the end of the anode insulator that is closest to the high voltage potential produced by the anode.

10. An x-ray tube as defined in claim 7, wherein the surface of at least one of the cathode and anode insulators to which the layer of coating material is applied is adjacent to the vacuum maintained by the vacuum enclosure.

11. An x-ray tube as defined in claim 10, wherein the layer of coating material has a thickness in a range between about 0 and $2/100^{th}$ of an inch.

12. An x-ray tube as defined in claim 11, wherein the coating material is selected from the group of materials consisting of: carbon, silver, copper, nickel, and chromium.

13. An x-ray tube as defined in claim 7, wherein the layer of coating material varies in electrical conductivity as a function of position on the surface of at least one of the cathode and anode insulators.

14. An x-ray tube as defined in claim 7, wherein the layer of coating material comprises two or more materials applied to different portions of the surface of at least one of the cathode and anode insulators.

* * * * *

UNITED STATES PATENT AND TRADEMARK OFFICE

CERTIFICATE OF CORRECTION

PATENT NO. : 6,819,741 B2
APPLICATION NO. : 10/378174
DATED : November 16, 2004
INVENTOR(S) : Charles Lynn Chidester It is certified that error appears in the above-identified patent and that said Letters Patent is hereby corrected as shown below:

Cover Page
Item (57), under "ABSTRACT", line 10, change "Through" to --Though--

Column 2
Line 23, after "their shape" insert --,--
Line 51, after "entire length" change "thereof" to --thereof.--
Line 52, after "portion of" insert --the--

Column 3
Line 39, before "length of the insulator" insert --the--
Line 42, before "the portion nearest" remove [than]
Line 43, before "the composition" change "Or," to --Alternatively,--

Column 4
Line 8, after "(such as reducing" change "aluminum" to --alumina--

Column 5
Line 65, before "motor," insert --a--

Column 6
Line 2, after "between the cathode" insert --16--

Column 7
Line 43, before "the cone vacuum" change "lo" to --to--

Column 9
Line 37, after "the inner surface" change "in" to --is--

Column 11
Line 6, after "cathode insulator" change "76," to --70,--

Signed and Sealed this

Thirtieth Day of November, 2010

David J. Kappos

David J. Kappos
*Director of the United States Patent and Trademark Office*